US008302574B2

(12) United States Patent
Ahn

(10) Patent No.: US 8,302,574 B2
(45) Date of Patent: Nov. 6, 2012

(54) FUEL PUMP LUBRICATION APPARATUS OF GDI ENGINE

(75) Inventor: Gil Hyun Ahn, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 183 days.

(21) Appl. No.: 12/844,548

(22) Filed: Jul. 27, 2010

(65) Prior Publication Data

US 2011/0126793 A1 Jun. 2, 2011

(30) Foreign Application Priority Data

Dec. 2, 2009 (KR) ..... 10-2009-0118733

(51) Int. Cl.
*F01M 1/06* (2006.01)
*F02M 37/04* (2006.01)

(52) U.S. Cl. ..... 123/90.33; 123/196 R; 123/508

(58) Field of Classification Search ..... 123/508, 123/509, 196 R, 90.33
See application file for complete search history.

(56) References Cited

U.S. PATENT DOCUMENTS

| | | | | |
|---|---|---|---|---|
| 4,476,836 | A * | 10/1984 | Enomoto et al. | 123/502 |
| 4,538,561 | A * | 9/1985 | Amemori et al. | 123/90.44 |
| 5,398,658 | A * | 3/1995 | Mesimaki | 123/509 |
| 5,603,303 | A * | 2/1997 | Okajima et al. | 123/508 |
| 5,984,650 | A * | 11/1999 | Okubo et al. | 417/470 |
| 7,673,604 | B2 * | 3/2010 | Takane et al. | 123/90.34 |
| 2008/0110332 | A1 * | 5/2008 | Yi | 92/163 |
| 2010/0071655 | A1 * | 3/2010 | Kim | 123/196 R |
| 2010/0139610 | A1 * | 6/2010 | Park | 123/196 R |
| 2011/0030649 | A1 * | 2/2011 | Nagao | 123/196 R |
| 2011/0100319 | A1 * | 5/2011 | Shin | 123/196 R |
| 2011/0126793 | A1 * | 6/2011 | Ahn | 123/196 R |
| 2011/0146626 | A1 * | 6/2011 | Maruyama et al. | 123/495 |

FOREIGN PATENT DOCUMENTS

KR 10-2009-0064095 A 6/2009

* cited by examiner

*Primary Examiner* — Thomas Moulis
(74) *Attorney, Agent, or Firm* — Morgan, Lewis & Bockius LLP

(57) ABSTRACT

A fuel pump lubrication apparatus for lubricating a fuel pump including a tappet and the fuel pump operating the tappet, may have a cylinder head including an oil gallery wherein a camshaft is disposed, an oil supply line communicated to the oil gallery, a lubrication cam cap slidably encompassing the camshaft, and a cam cap oil hole formed in the lubrication cam cap and ejecting oil received from the oil supply line to a contacting portion between the pump cam and a plunger of the fuel pump.

6 Claims, 5 Drawing Sheets

FUEL PUMP LUBRICATION APPARATUS OF GDI ENGINE

CROSS-REFERENCE TO RELATED APPLICATION

The present application claims priority to Korean Patent Application No. 10-2009-0118733 filed in the Korean Intellectual Property Office on Dec. 2, 2009, the entire contents of which is incorporated herein for all purposes by this reference.

BACKGROUND OF THE INVENTION

1. Field of the Invention

The present invention relates to an engine, and more particularly to a fuel pump lubrication apparatus of a GDI engine.

2. Description of Related Art

Technologies for a gasoline direct injection (GDI) engine have been studied in order to improve fuel consumption and performance of the engine.

The GDI engine technologies are methods in which only air is drawn into the combustion chamber and is compressed and then fuel is injected therein, while in the case of a conventional gasoline engine, power is generated in a period of an intake stroke, a compression stroke, and ignition stroke, and an exhaust stroke process of an air/fuel mixture.

Such a method is similar to a compressed ignition engine method.

Due to a high compression ratio of the GDI engine, a high compression ratio that is capable of exceeding a limit of a usual gasoline engine results in maximization of fuel consumption.

The GDI engine depends on a high fuel pressure, and a high performance fuel pump is required.

The fuel pump is mechanically driven by a cam so as to operate a tappet, and friction inside the fuel pump is generated.

A great deal of friction occurs in the fuel pump due to the high pressure of the fuel.

Therefore, a lubrication device of the fuel pump for compressing the fuel in the GDI engine has been studied in order to improve durability and performance of the GDI engine.

To solve the problems, as an example, a method of lubricating the cam with oil stored in a predetermined space when a camshaft for the fuel pump is rotated is used.

Such a method has a merit of simplifying the structure, but it is difficult to lubricate throughout the fuel pump, and it is difficult to lubricate it at a slanted surface.

Further, there is a method, as another example, which forms an oil hole at the cam so as to flow oil therein.

However, the method mentioned above has a drawback in that it is capable of lubricating only a specific part that is provided with an oil hole, and it is impossible to form a hole at a portion of the cam contacting the tappet of the fuel pump.

In addition, because the conventional lubrication device for a pump includes a plurality of curves, resistance occurs while supplying oil, and further, in case of processing and assembling for a cylinder head, a cam carrier, and an oil hole of an adaptor, a mismatch between a lubrication circuit oil hole and a blocked oil hole caused by burr/processing chips may occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a fuel pump lubrication apparatus of a GDI engine having advantages of improving design freedom and performance by a groove formed at a conventional saddle of a cam so as to supply oil to a cam lobe of a fuel pump.

In an aspect of the present invention, a fuel pump lubrication apparatus for lubricating a fuel pump including a tappet and the fuel pump operating the tappet may include a cylinder head including an oil gallery wherein a camshaft is disposed, an oil supply line communicated to the oil gallery, a lubrication cam cap slidably encompassing the camshaft, and a cam cap oil hole formed in the lubrication cam cap and ejecting oil received from the oil supply line to a contacting portion between the pump cam and a plunger of the fuel pump.

The oil supply line may be formed such that oil is sequentially supplied from the oil gallery to a cam saddle of a cylinder head, a saddle groove formed to the cam saddle to receive the oil, a cam cap groove formed to the lubrication cam cap and fluid-connecting between the saddle groove and an oil injection passage of the lubrication cam cap, and a cam cap oil hole formed in the lubrication cam cap and connected to the oil injection passage.

The oil injection passage may be formed to pass through the lubrication cam cap in a lateral side and one side thereof is formed with the cam cap oil hole and the other side thereof is detachably clogged with a blocking member.

An end portion of the cam cap oil hole may be formed with a gradually enlarged shape toward the pump cam.

The cam cap oil hole may be formed to aim at a place of a peak of a cam lobe of the pump cam.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
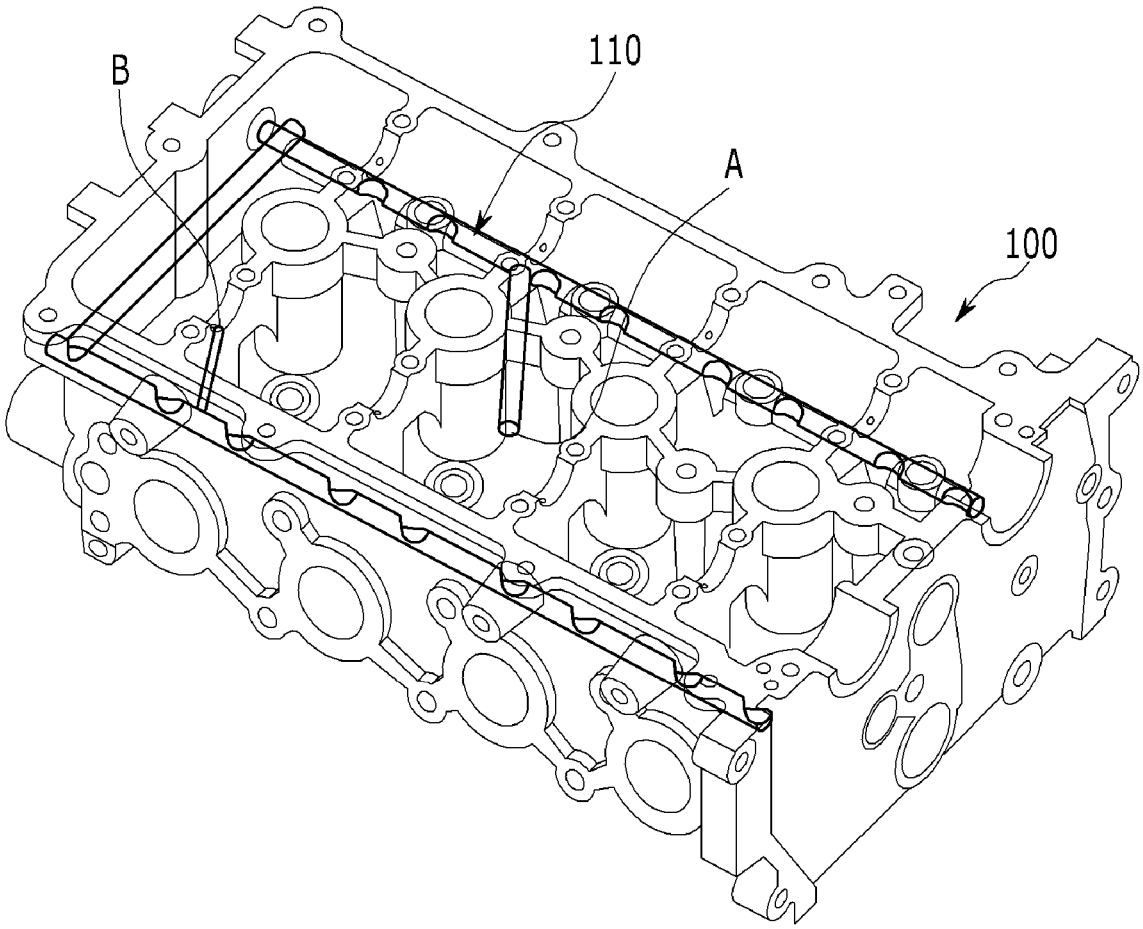
FIG. 1 shows an oil gallery applied to a fuel pump lubricating apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 shows an oil gallery applied to a fuel pump lubricating apparatus according to an exemplary embodiment of the present invention.

As shown in FIG. 1, oil is supplied from an oil gallery formed inside a cylinder block (not shown) to an A portion of an oil gallery 110 formed inside a cylinder head 100.

At this time, a plurality of cam caps encompass a camshaft 400 at the cylinder head 100, and at least one or more cam caps are formed such as a lubrication cam cap according to an exemplary embodiment of the present invention.

Oil is supplied from an engine pump (not shown) to the oil gallery 110 of the cylinder head 100.

In this present invention, the camshaft 400 can be formed as a hollow type or a solid type.

Herein, when forming the camshaft 400 as a hollow type, the hollow portion is included in the oil gallery 110.

Further, the oil is supplied from the B portion of the oil gallery 110 to a cam saddle 310 via an oil supply line 300.

Figure 2:
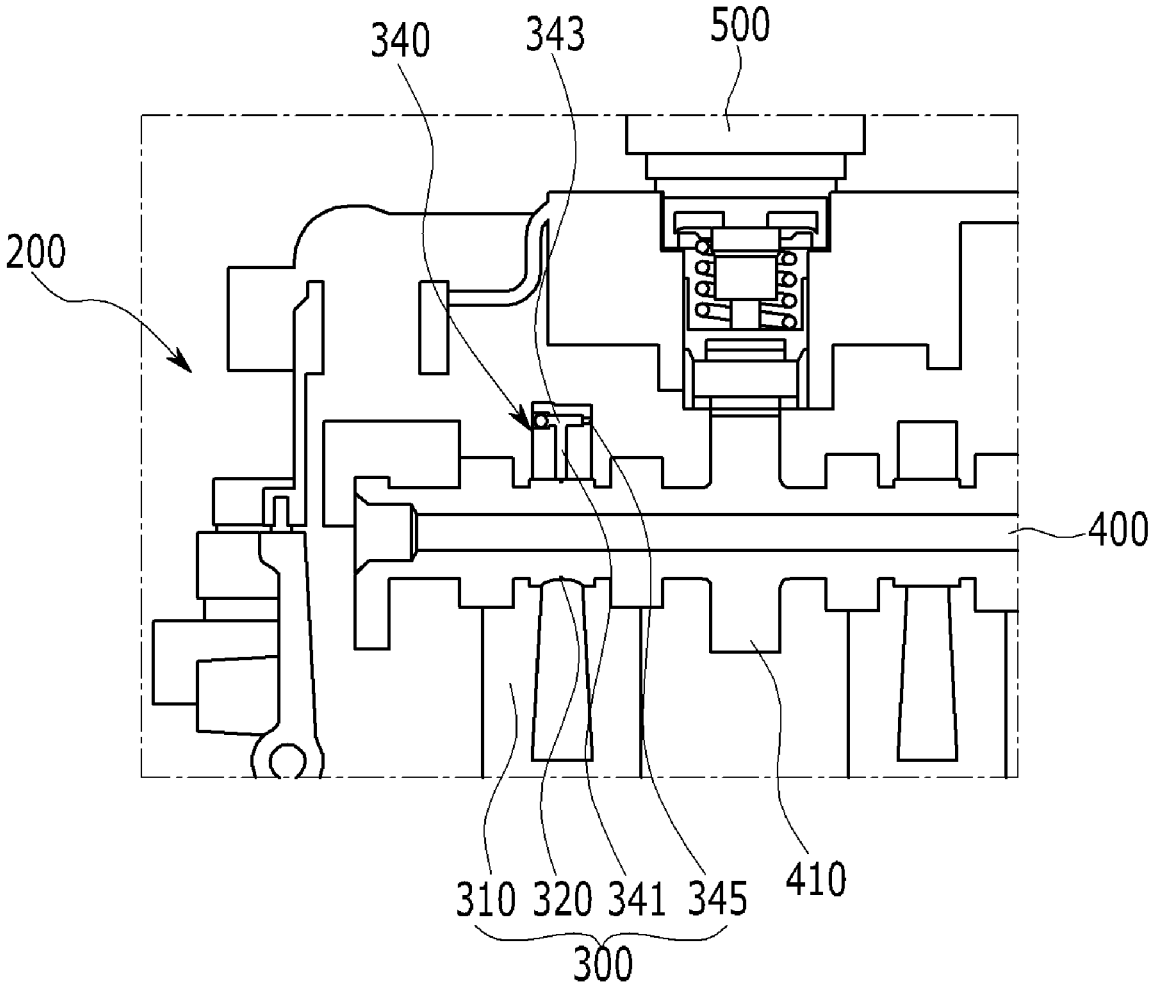
FIG. 2 shows a cross-sectional view of a fuel pump lubricating apparatus according to an exemplary embodiment of the present invention.
Figure 3:
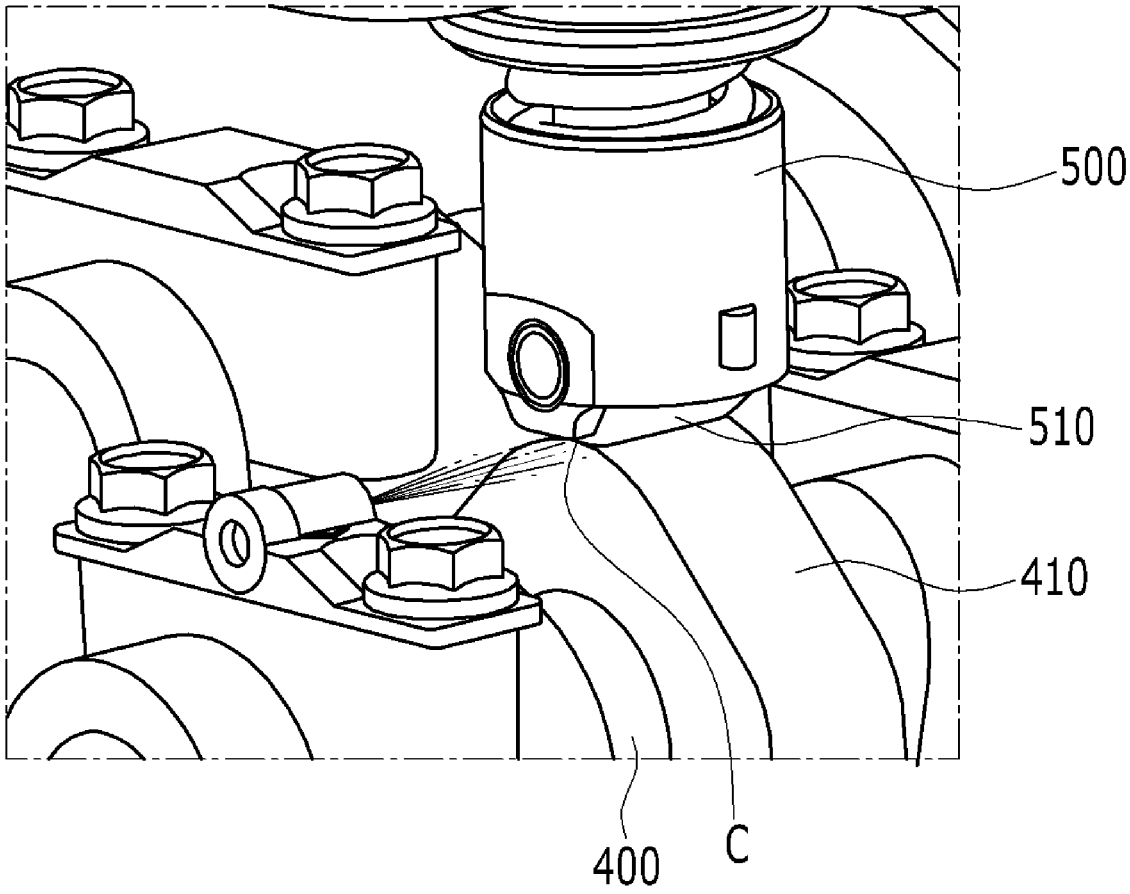
FIG. 3 shows a perspective view of the bottom of a cam cap applied to a fuel pump lubricating apparatus according to an exemplary embodiment of the present invention.
Figure 4:
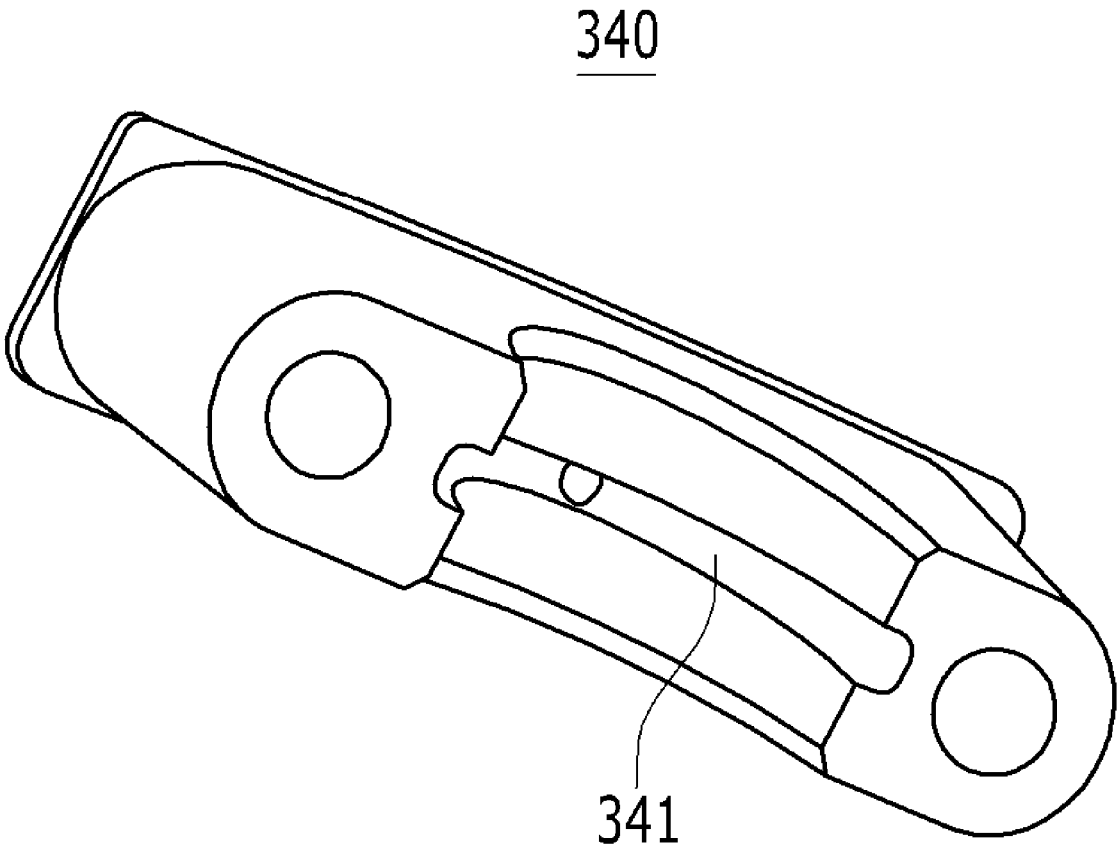
FIG. 4 shows a vertical cross-sectional view of FIG. 3.

Thus, as shown in FIG. 2, the oil received from the oil gallery 110 is supplied to the cam saddle 310.

The cam saddle 310 supports the lower half of the camshaft 400 so as to allow the camshaft 400 to rotate therein.

Because the cam saddle 310 has a saddle groove 320 encompassing the lower half of the camshaft 400, the oil supplied to the saddle groove 320 lubricates the camshaft 400.

Further, the oil is supplied to a cam cap groove 341 of the lubrication cam cap 340 encompassing the upper half of the camshaft 400 via the saddle groove 320.

As shown in FIG. 2 to FIG. 5, oil supplied through the saddle groove 320 of the cam saddle 310 is moved to the earn cap groove 341, and the oil is ejected through a cam cap oil hole 345 formed at one side of an upper portion of the lubrication cam cap 340.

Herein, the cam cap oil hole 345 is formed at one end of the lubrication cam cap 340, and ejects the oil to a contacting portion C of a pump cam 410 and a plunger 510 of the fuel pump 500.

Pressure generated by the oil depended on pressure generated by an oil pump of the engine.

That is, the oil supplied from the pump cam 410 is ejected to the contacting portion C through the cam cap oil hole 345.

For this purpose, an oil injection passage 343 is formed inside the lubrication cam cap 340 so as to be connected to the cam cap oil hole 345 via a hollow portion of the camshaft 400.

Further, at least one or more connecting passages (not shown) are formed at the camshaft 400 so as to be connected to the oil injection passages 343 of the lubrication cam caps 340.

Therefore, when the camshaft 400 is rotated according to the engine and the oil injection passage 343 is connected to the connecting passage, hydraulic pressure generated from the oil pump is supplied to the oil injection passage 343 through the hollow portion and the connecting passage, and then the hydraulic pressure is supplied to the cam cap oil hole 345 so as to eject the oil to the contacting portion C.

Further, a blocking member 342 is formed at an opposite side of the cam cap oil hole 345.

Herein, the blocking member 342 guides the oil to move to the pump cam 410, and it may preferably be manufactured and the like after a drill process of the lubrication cam cap 340 such that the process thereof can be easy.

Figure 5:
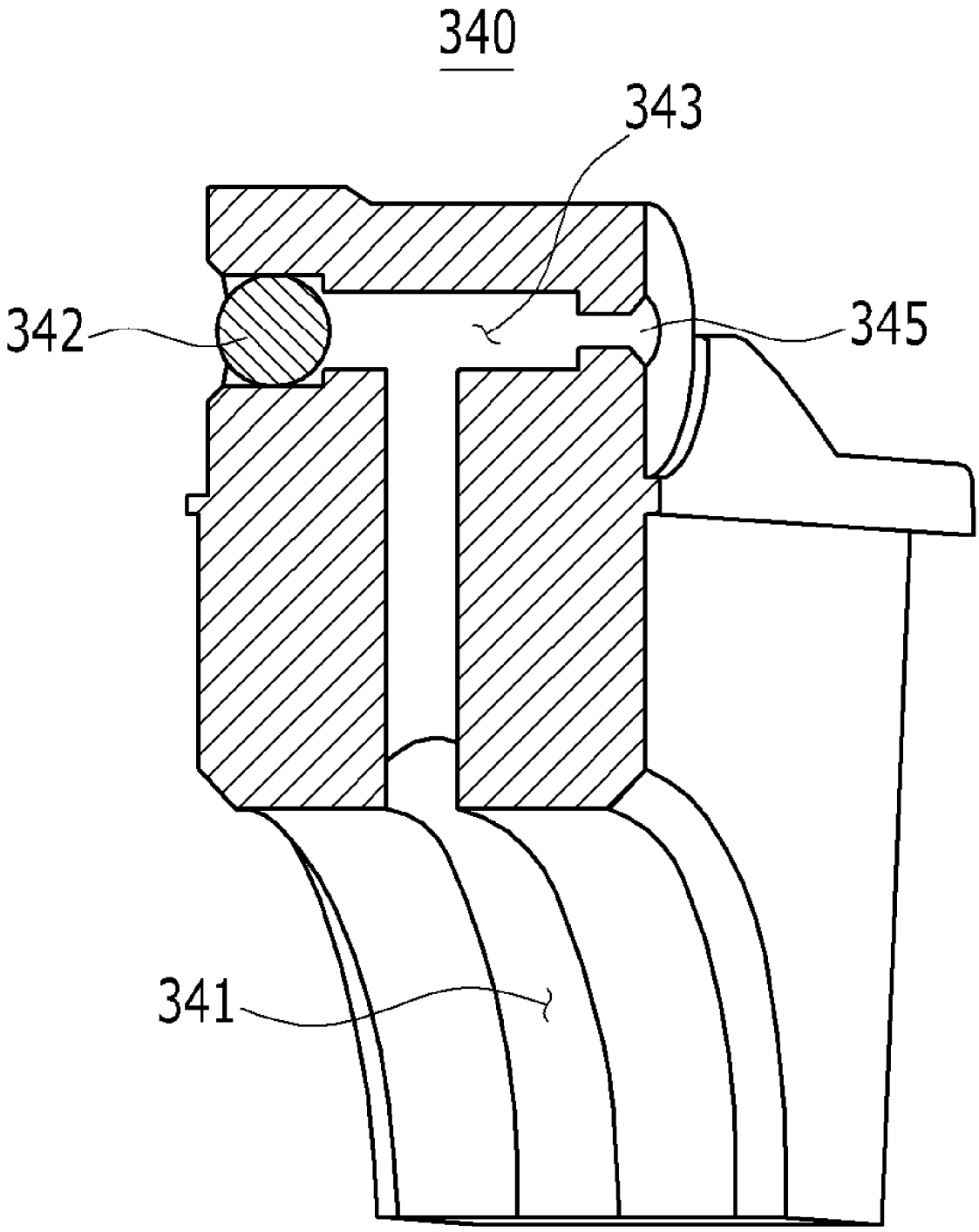
FIG. 5 shows an operating state of a fuel pump lubricating apparatus according to an exemplary embodiment of the present invention.

As shown in FIG. 5, oil is ejected at a predetermined hydraulic pressure through the cam cap oil hole 345, and the target position is based on the peak of the cam lobe (not shown) of the pump cam 410.

The height will be hereinafter described in detail.

Further, an operation of the fuel pump lubrication apparatus of a GDI engine according to an exemplary embodiment of the present invention will be hereinafter described in detail.

Firstly, the method in which the oil is supplied from the cylinder block to the cam saddle 310 of the cylinder head 100 is the same as with an MPI type, and oil supplied to the cam saddle 310 of the cylinder head 100 is provided to the saddle groove 320.

The oil of the saddle groove 320 is supplied to the cam cap groove 341 of the lubrication cam cap 340.

Further, oil supplied to the cam cap groove 341 is supplied to the cam cap oil hole 345 of the lubrication cam cap 340.

Herein, an end portion of the cam cap oil hole 345 is formed with a gradually enlarged nozzle, and it aims at a place of a peak of a fuel pump tappet drive cam.

Thus, in the case of the peak of the pump cam 410, incompressible fuel is momentary compressed, by i.e. 150 bar, so considerable resistance is exerted on the cam lobe.

In this reason, the place where the cam cap oil hole 345 is aimed must be determined concerning durability.

Further, when the pump cam 410 is at peak thereof, oil ejected from the end of the cam cap oil hole 345 is aimed at a position of the peak of the pump cam 410, so a contacting portion between the pump cam 410 and the roller tappet are lubricated and cooled.

Further, the oil flowing downwardly by the camshaft 400 and rotating tappet contacted thereto indirectly lubricates a portion between the roller tappet and an aluminum head cover.

Meanwhile, when the pump cam 410 is at the bottom thereof, oil ejected from an end of the cam cap oil hole 345 is aimed at a lower portion of the roller tappet, and at the same time, the oil is ejected even to the vicinity thereof due to an enlarged shape of the end of the cam cap oil hole 345, and thereby the pump cam 410, the roller, the tappet, and the head cover are lubricated simultaneously.

As can be seen from the forgoing, the fuel lubrication apparatus of GDI engine according to an exemplary embodiment of the present invention has an advantage of decreasing manufacturing cost by using a camshaft of a solid type and the number of process.

Further, because oil supplied from the saddle of the cylinder head is supplied from the cam cap directly to the fuel pump cam lobe through the camshaft, the oil passage is simplified and resistance occurring by the oil passage is reduced.

In addition, compared to an MPI type, the groove can be applied to a conventional cam saddle so as to supply oil to the fuel pump cam lobe, and it is just required to slightly modify the shape of a conventional cam cap.

Further, the enlarged-shape nozzle can easily lubricate an engine of a small type.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel pump lubrication apparatus for lubricating a fuel pump including a tappet and the fuel pump operating the tappet, comprising:

a cylinder head including an oil gallery wherein a camshaft is disposed;

an oil supply line fluid-communicated to the oil gallery;

a lubrication cam cap slidably encompassing the camshaft; and a cam cap oil hole formed in the lubrication cam cap and ejecting oil received from the oil supply line to a contacting portion between the pump cam and a plunger of the fuel pump;

wherein the oil supply line is formed such that oil is sequentially supplied from the oil gallery to a saddle groove formed to a cam saddle to receive the oil, a cam cap groove formed to the lubrication cam cap and fluid-connecting between the saddle groove and an oil injection passage of the lubrication cam cap, and the cam cap oil hole formed in the lubrication cam cap and fluid-connected to the oil injection passage;

wherein the cam saddle slidably supports the camshaft thereon; and wherein the cam shaft covers the saddle groove and the cam cap groove.

2. The apparatus of claim 1, wherein the oil injection passage is formed to pass through the lubrication cam cap in a lateral side and one side thereof is formed with the cam cap oil hole and the other side thereof is detachably clogged with a blocking member.

3. The apparatus of claim 1, wherein an end portion of the cam cap oil hole is formed with a gradually enlarged shape toward the pump cam.

4. The apparatus of claim 1, wherein the cam cap oil hole is formed to aim at a place of a peak of a cam lobe of the pump cam.

5. The apparatus of claim 1, wherein the saddle groove formed to the cam saddle encompasses a lower half of the camshaft.

6. The apparatus of claim 1, wherein the cam cap groove formed to the lubrication cam cap encompasses an upper half of the camshaft.

* * * * *